US005592937A

United States Patent [19]

Freund

[11] Patent Number: 5,592,937

[45] Date of Patent: Jan. 14, 1997

[54] RESPIRATOR MASK WITH STIFFENING ELEMENTS

[75] Inventor: Paul X. Freund, Mars, Pa.

[73] Assignee: Mine Safety Appliances Company, Pittsburgh, Pa.

[21] Appl. No.: 485,172

[22] Filed: Jun. 7, 1995

[51] Int. Cl.[6] ..... A62B 18/08; A62B 9/04

[52] U.S. Cl. ..... 128/206.16; 128/206.17; 128/206.28

[58] Field of Search ..... 128/206.21, 206.28, 128/206.12, 206.16, 207.12, 202.27, 205.27, 205.29, 206.19, 206.17

[56] References Cited

U.S. PATENT DOCUMENTS

| | | | |
|---|---|---|---|
| 2,205,368 | 10/1937 | Whipple | 128/206.16 |
| 2,652,828 | 9/1953 | Matheson | 128/206.17 |
| 2,706,983 | 4/1955 | Matheson et al. | 128/206.17 |
| 3,633,575 | 1/1972 | Brumfield | 128/206.15 |
| 4,414,973 | 11/1983 | Matheson et al. | 128/206.15 |
| 5,062,421 | 11/1991 | Burns et al. | 128/205.27 |

FOREIGN PATENT DOCUMENTS

| | | | |
|---|---|---|---|
| 493333 | 8/1919 | France | 128/206.12 |
| 5104 | 2/1913 | United Kingdom | 128/206.19 |
| 889933 | 2/1962 | United Kingdom | 128/206.19 |

*Primary Examiner*—Edgar S. Burr
*Assistant Examiner*—Daniel J. Colilla
*Attorney, Agent, or Firm*—James G. Uber; Debra M. Parrish

[57] ABSTRACT

The present invention provides a respirator mask having a very soft, compliant facepiece that has several stiffening elements integrated therein. The respirator mask preferably includes an exhalation valve and a pair of filter cartridges. It also has a yolk which complements the facepiece and provides for attachment of a harness to secure the respirator mask to the user's face. The respirator mask is lightweight and extremely comfortable due to the novel facepiece made of three stiffening elements which are completely surrounded by and bonded to a flexible material.

20 Claims, 2 Drawing Sheets

RESPIRATOR MASK WITH STIFFENING ELEMENTS

FIELD OF THE INVENTION

The present invention relates to respirator masks worn on a user's face for protection against gases, vapors and particulates, and more particularly to a half-mask respirator.

BACKGROUND OF THE INVENTION

Most respirators have a facepiece made of a soft compliant material, typically rubber, that rests against the wearer's face and forms a seal in conjunction with the wearer's facial skin. Some respirators are made of thick rubber to support the filters and exhalation valve attached thereto. See, e.g., U.S. Pat. Nos. 2,652,828 (Matheson) and 4,155,358 (McAllister et al.). Thick rubber can make the respirator heavy and uncomfortable to wear. Additionally, the thicker the rubber, the more costly it is to manufacture the respirator due to the incased material costs. If the rubber is made thinner, the mask tends to collapse onto the user's face, particularly while tightening the harness after donning the respirator. U.S. Pat. No. 5,062,421 (Burns) describes a respirator mask which incorporates a large single insert that serves as a structural member to support the facepiece. The disadvantage with the Burns respirator is that it is not flexible enough to provide a comfortable fit over a wide range of face sizes.

It is desirable, therefore, to provide a better fitting, lightweight respirator mask with a firm but flexible facepiece, that is more versatile and economical to make than existing respirator masks. Similarly, the respirator mask should be comfortable to wear for extended periods of time without collapsing on the user's face.

SUMMARY OF THE INVENTION

Generally, the present invention provides a very comfortable and lightweight respirator mask having a soft compliant facepiece with more than one stiffening elements integrated therein. Preferably, there are three stiffening elements which contain apertures and a mechanism for attaching filter cartridges and an exhalation valve to the facepiece. The integral stiffening elements are made of a lightweight rigid material, preferably a plastic such as polypropylene, and are joined by a flexible material, preferably thermoplastic rubber, such that the facepiece is flexible enough to provide a comfortable seal on the wearer's face but stiff enough to preclude collapse against the wearer's face. The respirator further comprises a yolk featuring a centered exhalation valve cover. The yolk wraps around the facepiece and has apertures that correspond to those in the stiffening elements. The filter cartridges are preferably attached to a connector on the appropriate stiffening elements. A harness is attached to the yolk to position and secure the respirator on the wearer's head. Such harness may be attached to the yolk by apertures on each arm of the yolk.

Other details and advantages of the present invention will become apparent as the following description of the invention proceeds.

THE DRAWINGS

In the accompanying drawings, preferred embodiments of the invention and preferred methods of practicing the invention are illustrated in which.

PRESENTLY PREFERRED EMBODIMENT

Figure 1:
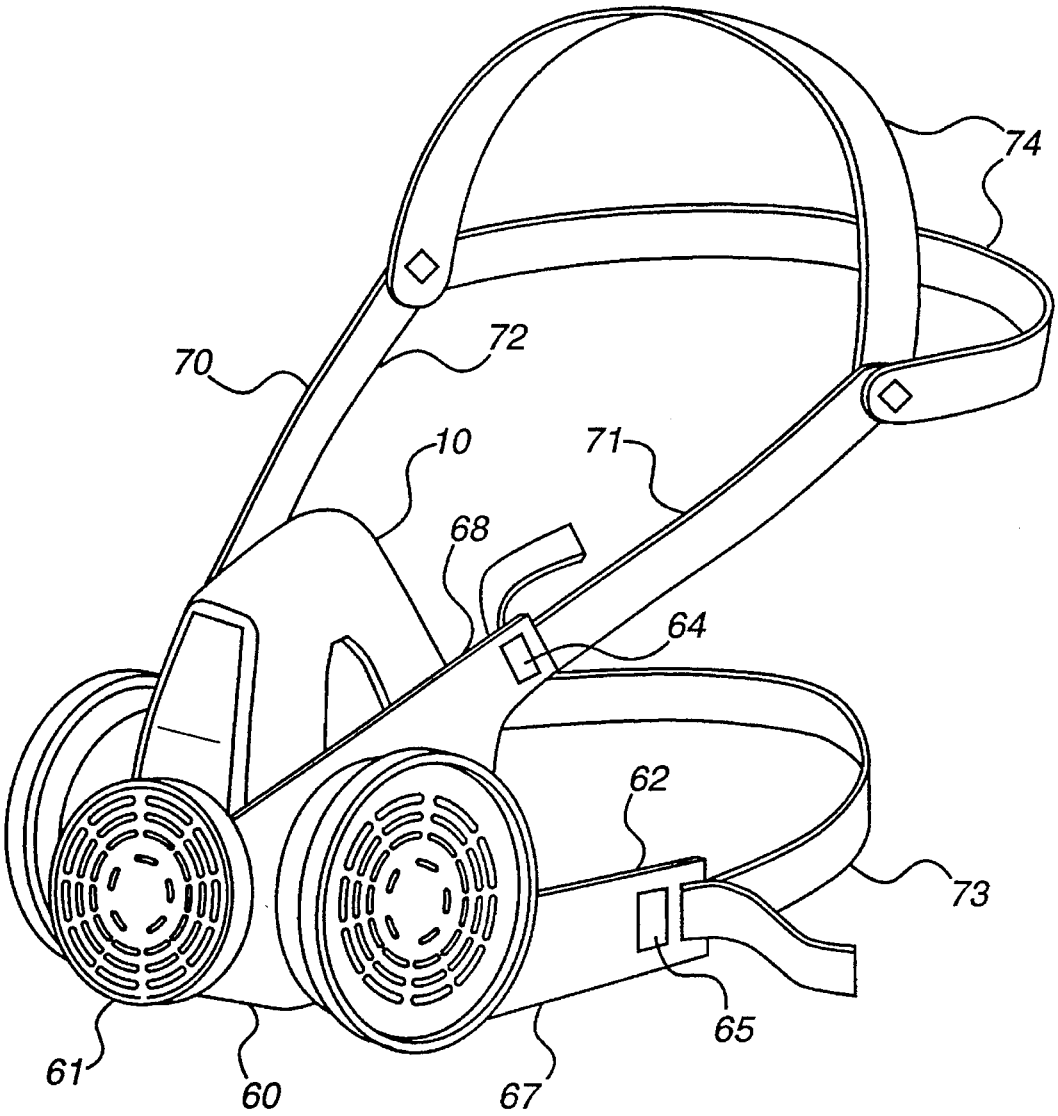
FIG. 1 is a perspective view of a respirator of the present invention.
Figure 2:
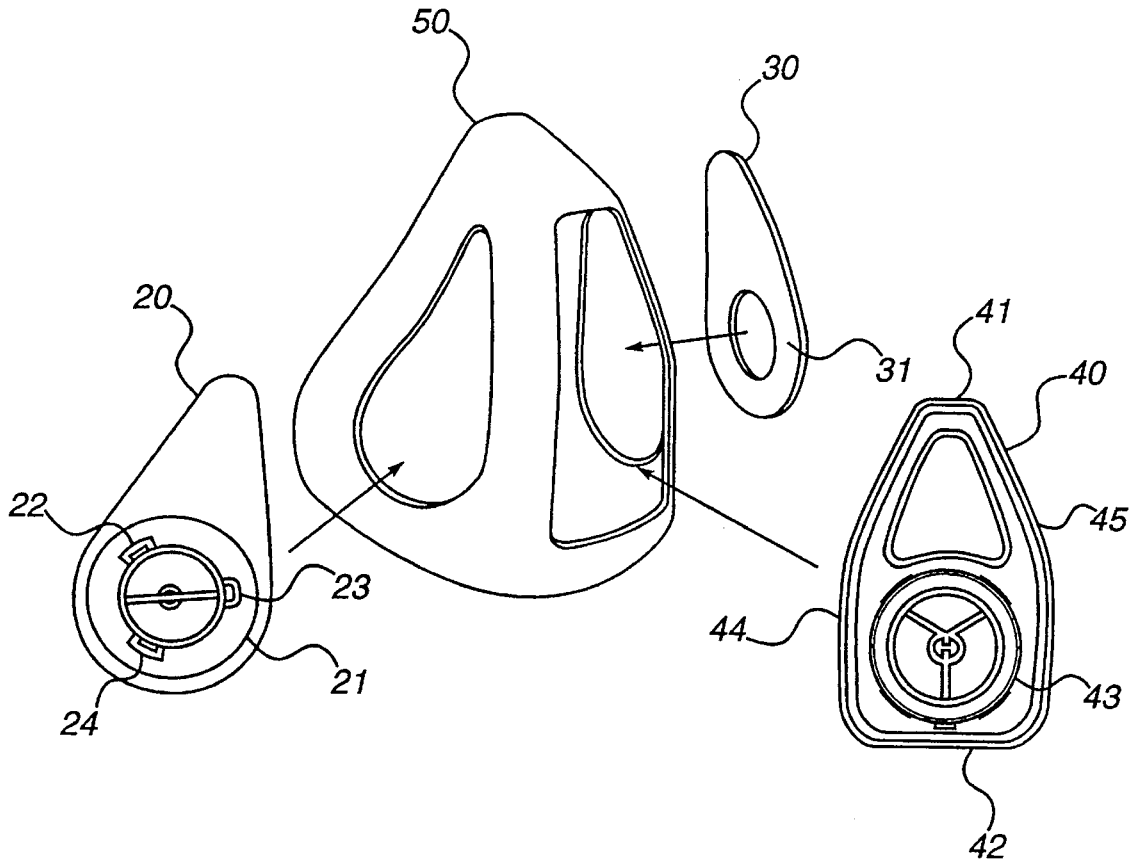
FIG. 2 is a perspective exploded view of a facepiece of the present invention.

A presently preferred embodiment of the invention is shown in FIGS. 1 and 2. Respirator facepiece 10 preferably comprises three stiffening elements 20, 30, and 40, respectively, made of a lightweight material, preferably a moldable plastic, and more preferably polypropylene or glass filled polypropylene, which are held together by a thermoplastic rubber 50, preferably one that has polypropylene in it such as kraton, starflex or sanoprene. Two of the stiffening elements 20 and 30 comprise the sides of the facepiece, are mirror images of each other, and are shaped substantially like teardrops with generally circular apertures 21 and 31, respectively, located in the base of the teardrop. The stiffening elements are bonded at their outer edge to ensure a seal with the rubber. Furthermore, the stiffening elements may be slightly curved to better accommodate facial features. The apertures 21 and 31 in the side stiffening members 20 and 30 are of sufficient size to accommodate commercially available filter cartridges and are adjacent to a connector for attaching such filters to the stiffening elements. In one embodiment, the side stiffening members possess flanges 22, 23, 24, for mating with the flanges of such filter cartridges.

The center stiffening member 40 is generally rectangular in shape, preferably with one end 41 being slightly narrower than the other end 42, and having an aperture 43 substantially centered from the sides of the rectangle 44 and 45 and located closer to the longer end of the rectangle. The aperture 43 in the center member is preferably circular and of sufficient size to accommodate an exhalation valve therein.

The flexible material 50 of the facepiece is preferably a thermoplastic rubber that has polypropylene in it. Preferably, it is made by injection molding using a cavity conforming to the desired shape of the facepiece and adapted to accommodate positioning the stiffening elements 20, 30, and 40 in their final desired positions in the facepiece. The center member 40 is positioned in the mold with the narrower end 41 of its rectangular shape on top and between the points of the two teardrop shaped side member 20 and 30 such that after molding the side members may move in hinge-like fashion in relation to the center member. When the thermoplastic rubber is injected into the mold, the thermoplastic rubber bonds directly to each stiffening element to form a seal around it. Preferably, each stiffening element is mechanically bonded to the rubber so that it can move relative to the adjacent stiffening elements and thereby provide the needed flexibility. The configuration of the mold, and the positioning of the stiffening elements therein, permits the thermoplastic rubber to completely surround each edge of every stiffening element, including the aperture edge, such that the stiffening elements are separated from one another by a strip of thermoplastic rubber, and each aperture in the side stiffening members is encased by the thermoplastic rubber so as to be able to form a friction fit with a filter cartridge. Alternatively, one could use other flexible materials which would form a chemical bond to the lightweight stiffening elements. Such flexible materials include hycar or silicon rubber. Of course, one would have to use a primer with these materials to achieve a chemical bond between the rubber and the stiffening elements.

A yolk 60 is typically placed on top of the facepiece 10. The yolk is made of a semi-rigid material, preferably plastic.

When the respirator is assembled, the yolk is centered on and extends across the exterior surface of the facepiece. In the center of the yolk is an exhalation valve cover 61 that mates with the exhalation valve aperture 43 of the facepiece. The yolk has two halves 62 that extend from opposing sides of the exhalation valve cover 61. Each half 62 of the yolk has a substantially circular aperture (not shown) that complements the corresponding substantially circular filter cartridge aperture 21 and 31 on the facepiece 10.

From each half 62 of the yolk 60 extend two prongs 67 and 68 that contain openings 64 and 65 at the end of each prong for receiving a harness 70 that will position and secure the facepiece 10 and yolk 60 to head of the wearer.

The harness 70 preferably consists of three adjustable elastic straps 71, 72 and 73 that are attached to the yolk 60. The top straps 71, 72 of the harness are attached to two strips of plastic that form a headband 74 which fits over the crown of the wearer's head. An adjustable bottom strap 73 fits around the wearer's neck and is threaded through an aperture 65 in the yolk. The wearer may adjust the fit of the respirator mask by tightening or loosening the elastic straps. Such adjustments may be made while the respirator mask is worn.

Although the invention has been described in detail above for the purpose of illustration, it is to be understood that such detail is solely for that purpose and that variations can be made therein by those of ordinary skill in the art without departing from the spirit and scope of the invention as defined by the following claims including all equivalents thereof.

What is claimed is:

1. In a respiratory mask having a facepiece with filter cartridges attached thereto, the improvement wherein the facepiece comprises a flexible material and a plurality of stiffening elements which are stiffer than the flexible material and are connected together by the flexible material, each of the stiffening elements having at least one substantially straight edge with adjacent straight edges of adjacent stiffening elements being substantially parallel to provide a hinge-like connection by the flexible material.

2. The respiratory mask as in claim 1 wherein there are three stiffening elements.

3. The respiratory mask as in claim 2, wherein the three stiffening elements comprise two side members, each with an aperture and connector to accommodate a filter cartridge, and a center member with an aperture to accommodate an exhalation valve.

4. The respiratory mask as in claim 3 wherein each side member is generally tear-drop shaped and the center member is generally oblong with a square end.

5. The respiratory mask as in claim 2 wherein the stiffening elements are made of plastic material.

6. The respiratory mask as in claim 5 wherein the plastic material comprises polypropylene.

7. The respiratory mask as in claim 2 wherein the flexible material comprises thermoplastic rubber.

8. A facepiece for a respiratory mask comprising a plurality of plastic stiffening elements connected together by a flexible rubber, each of their stiffening elements having at least one substantially straight edge with adjacent straight edges of adjacent stiffening elements being substantially parallel to provide a hinge-like connection by the flexible material.

9. The facepiece as in claim 8 wherein the flexible rubber is mechanically bonded to and completely surrounds each plastic stiffening element.

10. The facepiece as in claim 9 wherein there are three stiffening elements.

11. The facepiece as in claim 10, wherein the three stiffening elements comprise two side members, each with an aperture and a connector to accommodate a filter cartridge, and a center member with an aperture to accommodate an exhalation valve.

12. The facepiece as in claim 11 wherein each side member is generally tear-drop shaped and the center member is generally oblong shaped with a square end.

13. The facepiece as in claim 11, wherein each side member is generally tear-drop shaped.

14. The facepiece as in claim 13, wherein the center member is generally oblong shaped with a square end.

15. A respiratory mask comprising:

a facepiece wherein a plurality of stiffening elements are connected together by a flexible material;

the stiffening elements being stiffer than the flexible material;

each of the stiffening elements having at least one substantially straight edge with adjacent straight edges of adjacent stiffening elements being substantially parallel to provide a hinge-like connection by the flexible material;

a filter cartridge connected to the facepiece;

and exhalation valve connected to the facepiece;

and a harness connected to the facepiece.

16. The respiratory mask as in claim 15 wherein them are three stiffening elements.

17. The respiratory mask as in claim 16, wherein the three stiffening elements comprise two side members, each with an aperture and a connector to accommodate a filter cartridge, and a center member with an aperture to accommodate an exhalation valve.

18. A respiratory mask as in claim 17 wherein the connector comprises a plurality of flanges for a bayonet-type mounting mechanism that will mate with a plurality of flanges on the filter cartridge.

19. A respiratory mask as in claim 16 wherein the stiffening elements comprise polypropylene.

20. A respiratory mask as in claim 19 wherein the flexible material comprises thermoplastic rubber that has polypropylene in it.

* * * * *